US006145320A

United States Patent [19]

Kim

[11] Patent Number: 6,145,320

[45] Date of Patent: Nov. 14, 2000

[54] AUTOMATIC ICE MAKER USING THERMOACOUSTIC REFRIGERATION AND REFRIGERATOR HAVING THE SAME

[75] Inventor: Jae-Hee Kim, Seoul, Rep. of Korea

[73] Assignee: Daewoo Electronics Co., Ltd., Seoul, Rep. of Korea

[21] Appl. No.: 09/210,661

[22] Filed: Dec. 14, 1998

[51] Int. Cl.[7] ..... F25B 9/06

[52] U.S. Cl. ..... 62/6; 62/346

[58] Field of Search ..... 62/6, 66, 340

[56] References Cited

U.S. PATENT DOCUMENTS

| | | | |
|---|---|---|---|
| 3,059,445 | 10/1962 | Kniffin | 62/135 |
| 5,165,243 | 11/1992 | Bennett | 62/6 |
| 5,177,980 | 1/1993 | Kawamoto et al. | 62/353 |
| 5,303,555 | 4/1994 | Chrysler et al. | 62/6 |
| 5,400,605 | 3/1995 | Jeong | 62/72 |
| 5,425,248 | 6/1995 | Trantina | 62/349 |
| 5,456,082 | 10/1995 | Keolian et al. | 62/6 |
| 5,579,399 | 11/1996 | Lucas | 62/6 |
| 5,647,216 | 7/1997 | Garrett | 62/6 |
| 5,673,561 | 10/1997 | Moss | 62/6 |
| 5,813,234 | 9/1998 | Wighard | 62/6 |

*Primary Examiner*—William E. Tapolcai
*Attorney, Agent, or Firm*—Pillsbury Madison & Sutro LLP

[57] ABSTRACT

An automatic ice maker for saving an ice making time. The automatic ice maker has a U-shaped resonator filled up with an inertia gas, a pair of ice trays attached to both ends of the U-shaped resonator in a reverse direction to each other, a pair of speakers attached to both ends of the U-shaped resonator for compressing and expanding parcels of the inertia gas by applying an acoustic pressure to the U-shaped resonator thereby varying a temperature distribution in the U-shaped resonator, a pair of heat exchangers for transferring an inner temperature of the U-shaped resonator to the ice trays, a reversible motor for driving the U-shaped resonator in a forward or a reverse direction at an angle of 180 degrees, and an electric control unit for sequentially operating the speakers and the reversible motor. The automatic ice maker can be adopted to a refrigerator or other refrigeration system. By the automatic ice maker, the ice making time can be saved and the productivity in making the ice increases.

15 Claims, 5 Drawing Sheets

AUTOMATIC ICE MAKER USING THERMOACOUSTIC REFRIGERATION AND REFRIGERATOR HAVING THE SAME

BACKGROUND OF THE INVENTION

1. Field of the Invention

The present invention relates to an automatic ice maker, and more particularly to an automatic ice maker capable of saving an ice making time by using thermoacoustic refrigeration, and a refrigerator having the automatic ice maker.

2. Description of the Prior Art

Generally, a refrigerator is an apparatus for storing various foods in either a frozen or refrigerated condition to keep freshness of the foods for a long time. Such a refrigerator includes a compressor which circulates a refrigerant by compressing the refrigerant, a condenser for condensing the refrigerant to a liquid phase, and an evaporator for generating a chilled air by evaporating the liquid phase refrigerant.

The refrigerator has a freezing chamber for storing frozen foods such as meats or an ice cream, and a refrigerating chamber for storing foods at a relatively lower temperature. The chilled air generated by the evaporator is introduced into the refrigerating and freezing chambers by a fan.

An ice maker having an ice tray is installed in the freezing chamber for making an ice by using the low temperature of the freezing chamber. A water supply device feeds water into the ice tray and a driving device rotates the ice tray to separate the ice from the ice tray when an ice making process has been completed.

Examples of the ice maker are disclosed in U.S. Pat. No. 5,177,980 (issued to Akira Kawamoto, et al.) and U.S. Pat. No. 5,400,605 (issued to Sung-Ki Jeong).

FIG. 1 is a perspective view for showing a conventional automatic ice maker. As illustrated in FIG. 1, a driving section (not shown) is disposed at a front portion of a freezing chamber, and a fixing member 41 which is protruded rearward and has an L-shape is disposed at one end of the rear portion of the driving section. In the driving section, a driving apparatus having a motor, a gear mechanism and a rotating shaft 20 is installed. The driving apparatus reduces the rotation speed of the motor by the gear mechanism and transmits the reduced rotational speed to rotating shaft 20.

In fixing member 41, an ice tray 10 is disposed. At the front center portion of ice tray 10, a rotating pin 11 is formed. The front center portion of rotating pin 11 is connected to and supported by rotating shaft 20 which receives the rotational force generated by the motor. In addition, at the rear portion of ice tray 10, a supporting shaft 13 is formed. Ice tray 10 is rotatably fixed to fixing member 41 through supporting shaft 13. The rotational force generated by the motor is transmitted to rotating shaft 20 through the gear mechanism, and the rotational force is transmitted to ice tray 10 through rotating pin 11. Accordingly, ice tray 10 can be rotated by the rotation of rotating shaft 20.

Ice tray 10 is made of synthetic resin, such as plastic, which can be twisted laterally. Ice tray 10 has a hexahedral shape of which the upper surface is opened. The inside of ice tray 10 is partitioned into a plurality of concave portions to make the ice. The cross-section of the side portion of the concave portion has a reverse mesa shape for advantageously removing the ice from ice tray 10. Water is supplied into ice tray 10 by a water feeding apparatus.

At the rear portion of ice tray 10, that is, at one edge portion where supporting shaft 13 is formed, an ice separating plate 15 is formed along the length of ice tray 10. In addition, at one corner portion of fixing member 41, that is, at the corner portion opposite to ice separating plate 15, a stopper 31 is formed. Stopper 31 makes contact with ice separating plate 15 to limit the rotation of ice tray 10 when ice tray 10 is rotated to separate the ice from ice tray 10.

At the lower portion of the freezing chamber and below ice tray 10, an ice reservoir (not shown) is disposed. The separated ice through the rotation of ice tray 10 is stored in the ice reservoir.

FIG. 2 is a schematic perspective view for explaining the ice separating process in the conventional automatic ice maker.

In the conventional automatic ice maker illustrated in FIG. 1, when the ice is obtained in the concave portion of ice tray 10, a microcomputer (not shown) senses the ice through a temperature sensor (not shown) provided in ice tray 10. When the microcomputer determines that the ice is made in ice tray 10, the microcomputer sends an ice separating signal to the motor for driving the motor. The rotational force of the motor is transmitted to rotating pin 11 through rotating shaft 20 so that ice tray 10 rotates at an angle of 180 degrees, as illustrated in FIG. 2. At this time, ice separating plate 15 makes contact with stopper 31 for preventing a further rotation of ice tray 10. However, the rotational force of the motor is still transmitted to ice tray 10 through rotating pin 11. Accordingly, ice tray 10 is subjected to a torsional stress, so the ice formed in ice tray 10 is separated from ice tray 10 and falls down into the ice reservoir.

However, in the conventional automatic ice maker, the ice making is carried out by using the temperature of the freezing chamber, so a relatively long time is required for making the ice. If a user wants to rapidly make the ice, an energy loss results because the user should raise the temperature of the freezing chamber.

In order to overcome the above problem, a refrigerator having a separate ice making chamber in a freezing chamber is suggested. In the above refrigerator, a chilled air is guided into the ice making chamber through a duct so the ice making chamber has a relatively lower temperature than the temperature of the freezing chamber. However, this kind of refrigerator may reduce a usable space in the freezing chamber.

SUMMARY OF THE INVENTION

The present invention has been made to overcome the above described problem of the prior art. Accordingly, it is an object of the present invention to provide an automatic ice maker which can save an ice making time by making an ice by using a thermoacoustic refrigeration.

Another object of the present invention is to provide a refrigerator having a automatic ice maker which makes an ice by using a thermoacoustic refrigeration.

To accomplish the first object of the present invention, there is provided an automatic ice maker comprising:

- a resonator filled up with an inertia gas;
- at least one ice tray attached to the resonator;
- a first means for compressing and expanding parcels of the inertia gas by applying an acoustic pressure to the resonator thereby varying a temperature distribution in the resonator;
- a second means for transferring an inner temperature of the resonator to the ice tray;

a reversible motor for driving the resonator in a forward or a reverse direction at an angle of 180 degrees; and an electric control unit for sequentially operating the first means and the reversible motor.

To accomplish the second object of the present invention, there is provided a refrigerator comprising:

a housing having a refrigerating chamber, a freezing chamber, and an evaporator chamber which is disposed at a rear portion of the freezing chamber;

an evaporator for generating a chilled air, the evaporator being disposed in the evaporator chamber;

a fan assembly for blowing the chilled air generated by the evaporator into the refrigerating and freezing chambers;

a first means installed in the freezing chamber and filled up with an inertia gas;

at least one ice tray attached to the first means;

a water supplying device for supplying a water into the ice tray;

a second means for compressing and expanding parcels of the inertia gas by applying an acoustic pressure to the first means;

a third means for transferring an inner temperature of the first means to the ice tray;

a fourth means for driving the first means in a forward or a reverse direction; and an electric control unit for sequentially operating the first and fourth means.

According to the preferred embodiment of the present invention, the first means includes a U-shaped resonator filled up with a helium gas. The ice tray includes first ice tray and second ice tray which are disposed in a reverse direction to each other. The first ice tray is positioned on an upper surface of the first end of the U-shaped resonator, and the second ice tray is positioned on an lower surface of the second end of the U-shaped resonator.

The second means includes a first speaker attached to a front portion of a first end of the U-shaped resonator and a second speaker attached to a front portion of a second end of the U-shaped resonator. The electric control unit sequentially applies an electric signal to the first and second speakers with a time interval so that the first and second speakers are sequentially operated while maintaining the predetermined time interval.

The third means includes first and second heat exchangers provided in the U-shaped resonator. The first heat exchanger is adjacent to the first end of the U-shaped resonator and the second heat exchanger is adjacent to the second end of the U-shaped resonator. The fourth means includes a reversible motor installed in the evaporator chamber.

The water is supplied from the water supplying device into the first ice tray.

Then, the electric control unit operates the second speaker attached to the front portion of the second end of the U-shaped resonator.

Accordingly, the temperature of parcels of the helium gas adjacent to the second speaker is raised by adiabatic compression caused by a standing wave radiated from the second speaker, and the temperature of parcels of the helium gas remoted from the second speaker is lowered by adiabatic expansion. Accordingly, the second end of the U-shaped resonator is heated and the first end of the U-shaped resonator is chilled.

The first heat exchanger transfers the lowered temperature to the first ice tray thereby freezing the water filled in the first ice tray.

When a predetermined time lapses, the electric control unit operates the reversible motor so that the U-shaped resonator is rotated at an angle of 180 degrees by the reversible motor.

Then, the water is supplied into the second ice tray through the water supplying device and the electric control unit operates the first speaker attached to the front portion of the first end of the U-shaped resonator.

Accordingly, the first end of the U-shaped resonator is heated and the second end of the U-shaped resonator is chilled.

At this time, the first heat exchanger transfers the raised temperature to the first ice tray having ice cubes therein so that the ice cubes are separated from the first ice tray.

In addition, the second heat exchanger transfers the lowered temperature to the second ice tray so the water filled in the second ice tray is frozen.

The ice maker according to the present invention makes the ice by using the thermoacoustic refrigeration so that the ice making time can be saved.

In addition, the ice maker can rapidly makes the ice without controlling the temperature of the evaporator, so the temperature distribution in the freezing chamber can be uniformly maintained.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Hereinafter, a preferred embodiment of the present invention will be explained in detail with reference to the accompanying drawings.

Figure 1:
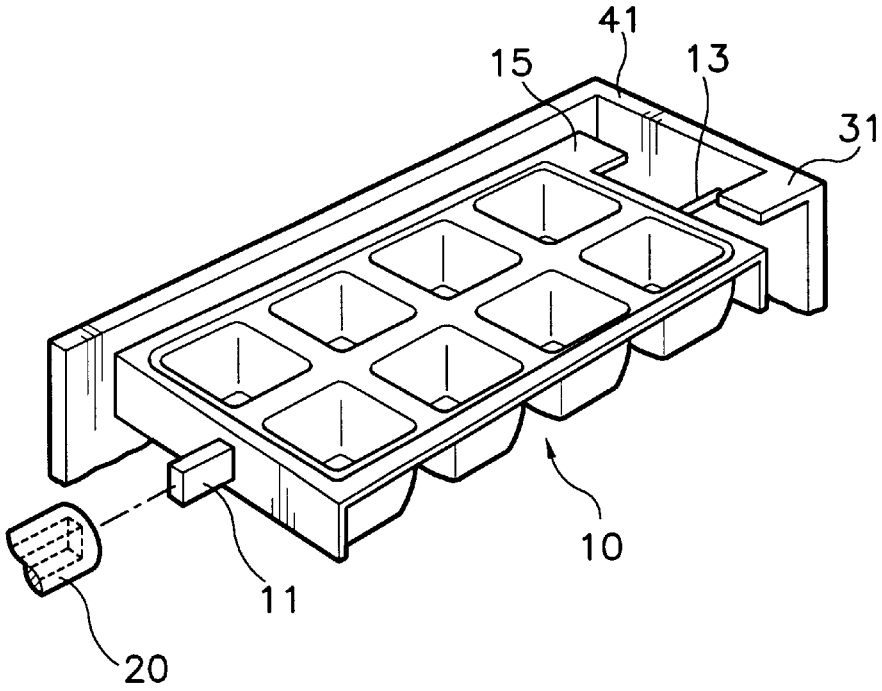
FIG. 1 (PRIOR ART)
FIG. 1 is a perspective view of a conventional automatic ice maker.
Figure 2:
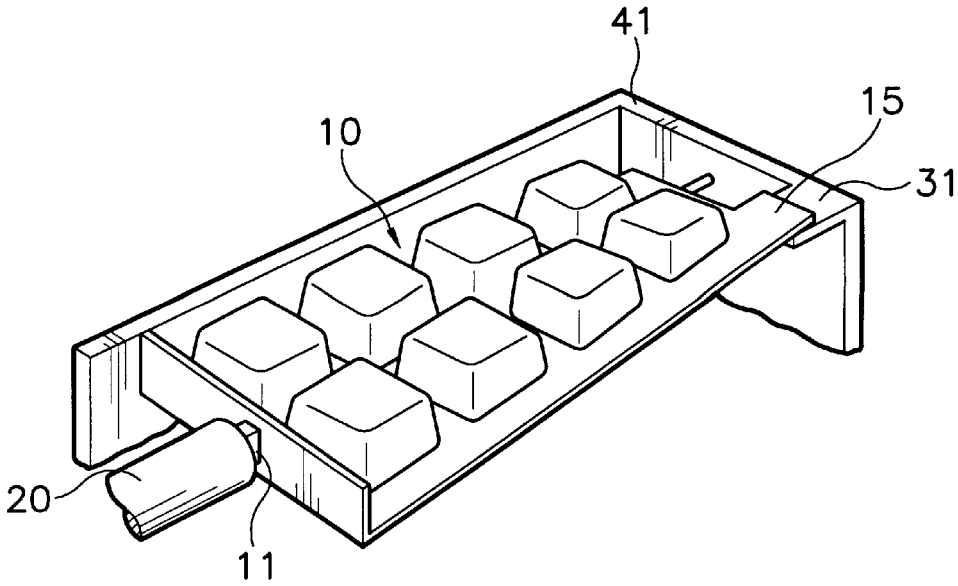
FIG. 2 (PRIOR ART)
FIG. 2 is an operational perspective view of a conventional automatic ice maker shown in FIG. 1.
Figure 3:
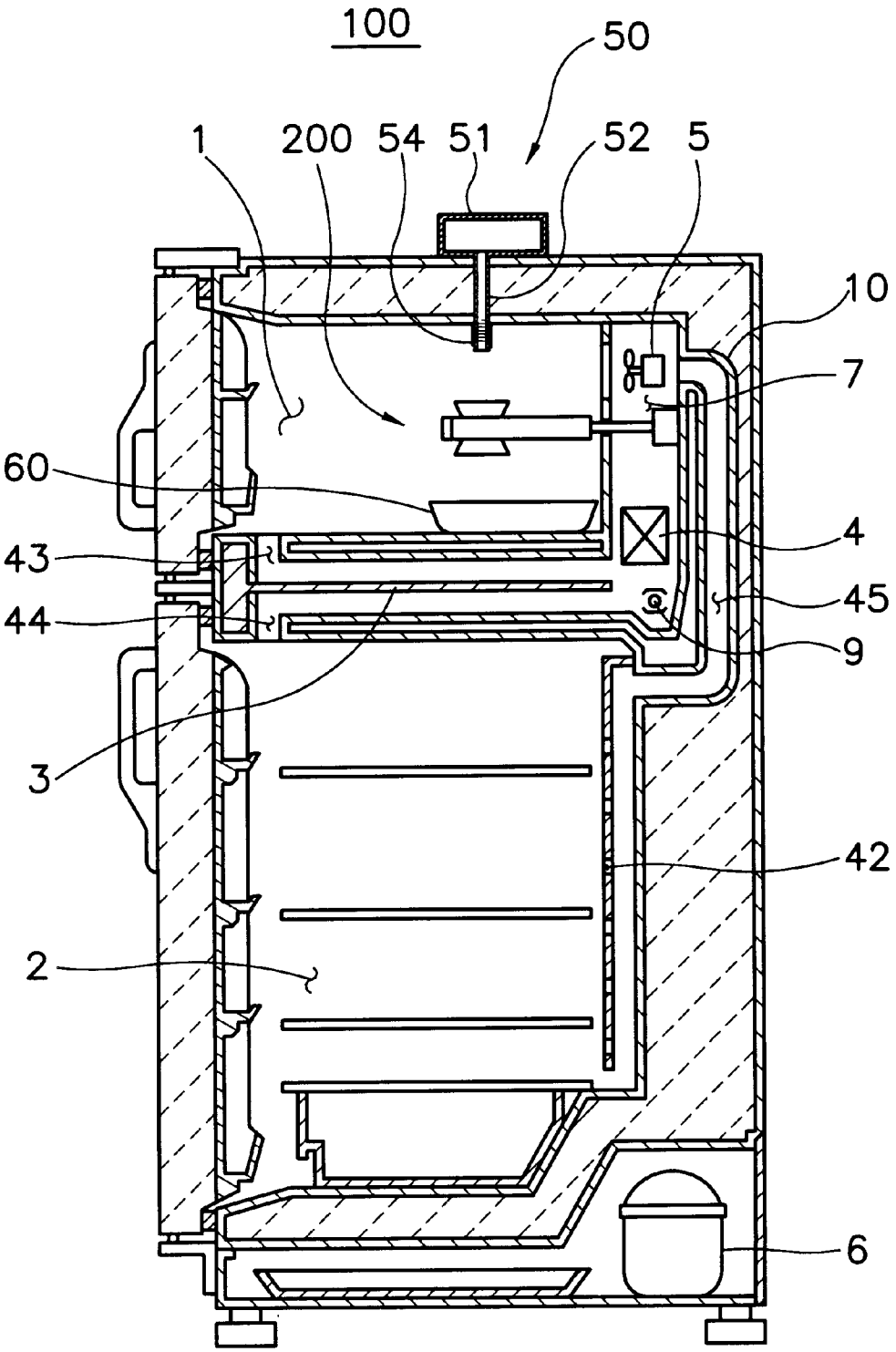
FIG. 3 is a sectional view having an automatic ice maker according to one embodiment of the present invention.

FIG. 3 shows a refrigerator 100 having an automatic ice maker 200 according to the present invention. The ice maker according to the present invention can also be adopted to a freezer or other refrigeration system.

As shown in FIG. 3, refrigerator 100 comprises a housing 10 having a refrigerating chamber 2 and a freezing chamber 1 which is separated from refrigerating chamber 2 by a partition wall 3. An evaporator chamber 7, in which an evaporator 4 is installed, is formed at a rear portion of freezing chamber 1. A compressor 6 is disposed below refrigerating chamber 2 and a condenser (not shown) is connected between compressor 6 and evaporator 4.

Compressor 6 compresses a refrigerant to a high-pressure and high-temperature refrigerant, and the condenser makes a liquid-phase refrigerant by discharging a heat from the high-pressure and high-temperature refrigerant. The liquid phase refrigerant is supplied to and evaporated by evaporator 4, thereby generating a chilled air. In addition, a heater 9 is installed below evaporator 4 so as to defrost a frost adhering to evaporator 4.

Installed above evaporator 4 is a fan assembly 5 for blowing an air toward freezing chamber 1. In addition, some of the chilled air is introduced into refrigerating chamber 2 through a chilled air duct 45 formed at a rear portion of evaporator chamber 7 and through a chilled air inlet 42 which is formed at a rear wall of refrigerating chamber 2. The chilled air which has been introduced into freezing and refrigerating chambers 1 and 2 is re-circulated into evaporator chamber 7 through first and second chilled air return passages 43 and 44 which are formed at a lower portion of freezing chamber 1 and at an upper portion of refrigerating chamber 2, respectively.

A main part of automatic ice maker 200 (hereinafter, simply referred to as ice maker) according to the present invention is installed in freezing chamber 1. An ice reservoir 60 is installed below ice maker 200 for storing the ice dropping from ice maker 200. Ice maker 200 will be more detailedly explained below with reference to FIGS. 4 to 6.

A water supplying device 50 for supplying water into ice maker 200 is disposed on an upper surface of housing 10. Water supplying device 50 includes a water tank 51 provided on the upper surface of housing 10 and a water supplying pipe 52 which is disposed at a lower portion of water tank 51 and extends into freezing chamber 1 by passing through an upper wall of housing 10. Water supplying pipe 52 is provided at a circumference thereof with a heating coil 54 for preventing water supplying pipe 52 from freezing.

Figure 4:
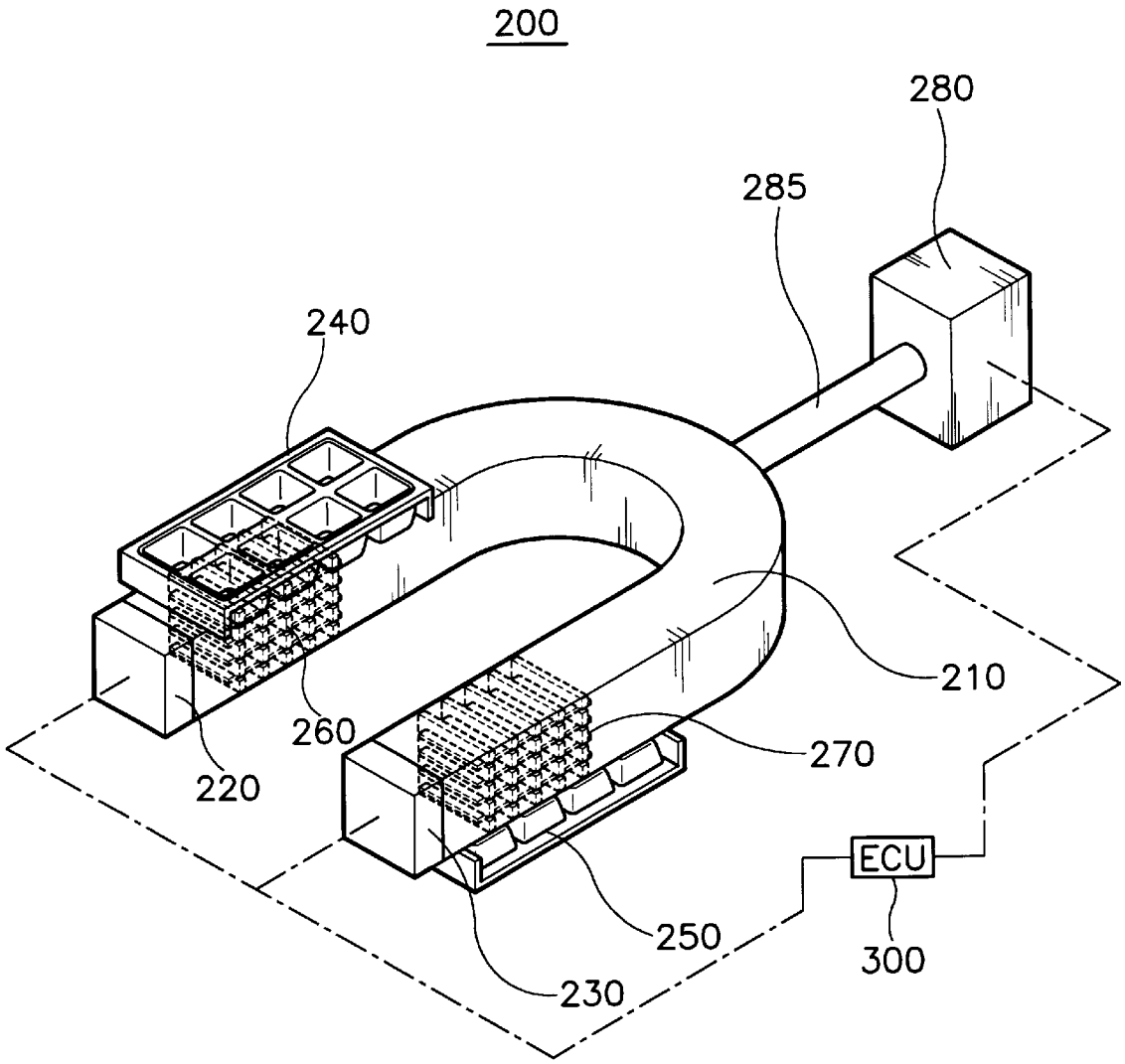
FIG. 4 is a perspective view of an automatic ice maker according to one embodiment of the present invention.

Referring to FIG. 4, ice maker 200 has a U-shaped resonator 210 filled up with an inertia gas, such as helium gas. Though the resonator is illustrated as a U-shape, the shape of the resonator can vary according to the embodiments. For example, a linearly shaped resonator can be used instead of the U-shaped resonator.

A first ice tray 240 for receiving the water from water supplying device 50 is positioned on an upper surface of a first end of U-shaped resonator 210, and a second ice tray 250 is positioned on a lower surface of a second end of U-shaped resonator 210. First ice tray 240 is arranged corresponding to water supply pipe 52 of water supplying device 50. However, if U-shaped resonator 210 rotates at an angle of 180 degrees, second ice tray 240 corresponds to water supply pipe 52 of water supplying device 50.

First and second ice trays 240 and 250 are secured to U-shaped resonator 210 by means of an ultraviolet bond or the like. According to another embodiment of the present invention, first and second ice trays 240 and 250 are detachably secured to U-shaped resonator 210.

When the ice making process is completed, U-shaped resonator 210 is rotated at the angle of 180 degrees by a reversible motor 280 which is installed in evaporator chamber 7. Reversible motor 280 is connected to an electric control unit 300 so as to be controlled by electric control unit 300. A rotating shaft 285 of reversible motor 280 extends into freezing chamber 1 and is connected to U-shaped resonator 210. Accordingly, U-shaped resonator 210 rotates in a driving direction of reversible motor 280.

Ice maker 200 further has first and second speakers 220 and 230 which apply an acoustic pressure to U-shaped resonator 210 thereby compressing and expanding parcels of the helium gas contained in U-shaped resonator 210.

When first or second speaker 220 or 230 operates, a temperature distribution in U-shaped resonator 210 varies. That is, the temperature of the parcels of the helium gas adjacent to the speaker generating the acoustic pressure is raised by adiabatic compression caused by a standing wave, and the temperature of the parcels of the helium gas remoted from the speaker is lowered by adiabatic expansion.

First speaker 220 is attached to a front portion of the first end of U-shaped resonator 210 and second speaker 230 is attached to a front portion of the second end of U-shaped resonator 210. First and second speakers 220 and 230 are connected to electric control unit 300. Electric control unit 300 sequentially applies an electric signal to first and second speakers 220 and 230 with a predetermined time interval so that first and second speakers 220 and 230 are sequentially operated while maintaining the predetermined time interval.

That is, when first ice tray 240 is filled up with the water, electric control unit 300 operates second speaker 230 thereby freezing the water filled in first ice tray 240. Then, after U-shaped resonator 210 rotates at the angle of 180 degrees by reversible motor 280, electric control unit 300 operates first speaker 220 thereby freezing the water filled in second ice tray 250.

On the other hand, first and second heat exchangers 260 and 270 are provided in U-shaped resonator 210 for transferring the inner temperature of U-shaped resonator 210 to first and second ice trays 240 and 250, respectively.

First heat exchanger 260 is adjacent to the first end of U-shaped resonator 210 and second heat exchanger 270 is adjacent to the second end of U-shaped resonator 210. More preferably, first and second heat exchangers 260 and 270 are positioned corresponding to first and second ice trays 240 and 250, respectively.

Figure 5:
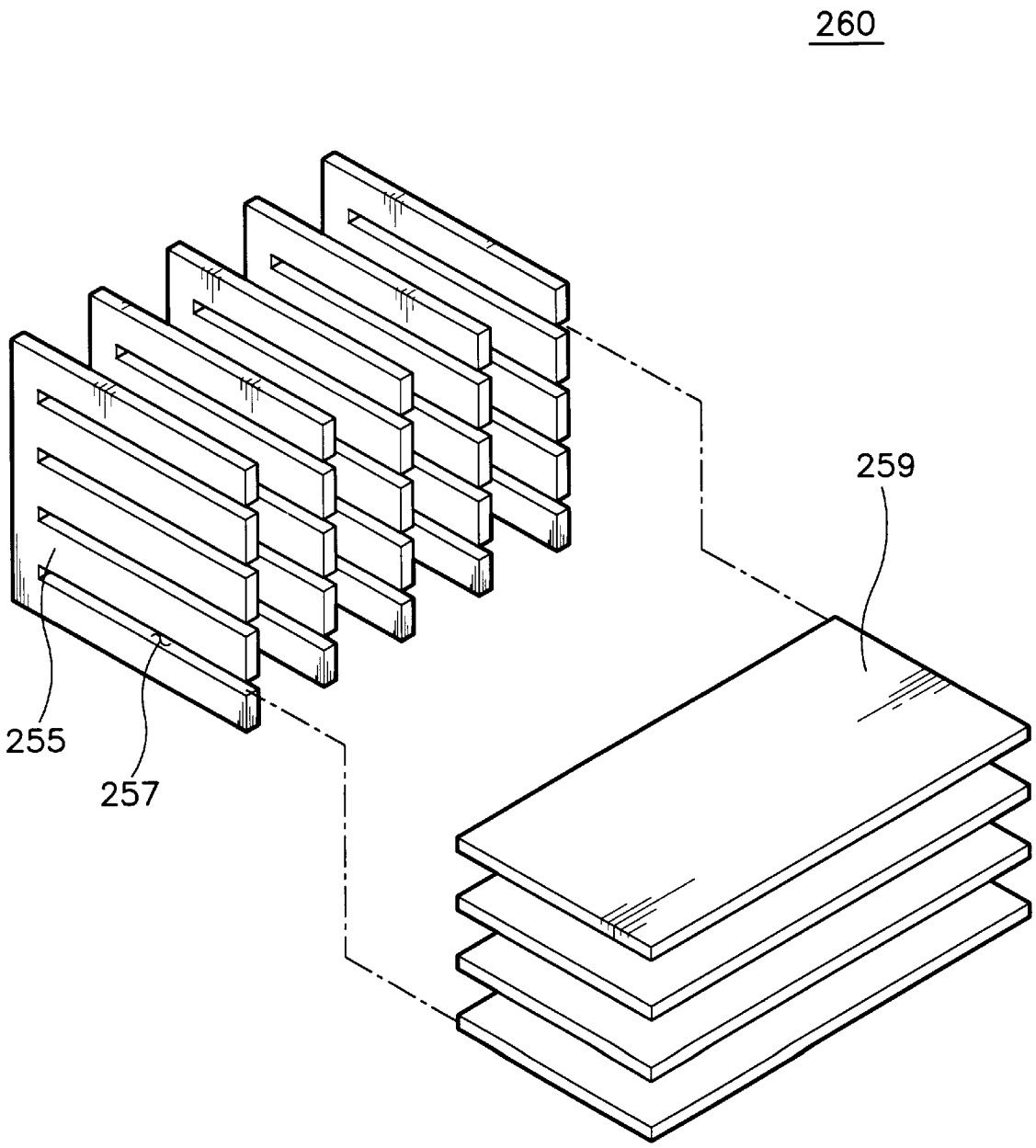
FIG. 5 is an exploded perspective view of a heat exchanger shown in FIG. 4.

Referring to FIG. 5, each heat exchanger has a lattice shape and includes a plurality of vertical plates 255 and a plurality of horizontal plates 259 which are coupled to vertical plates 255. Vertical plates 255 are positioned in a row and formed with a plurality of longitudinal slots 257. The plurality of horizontal plates 259 are inserted into longitudinal slots 257 so that vertical plates 255 are connected to one another.

Figure 6:
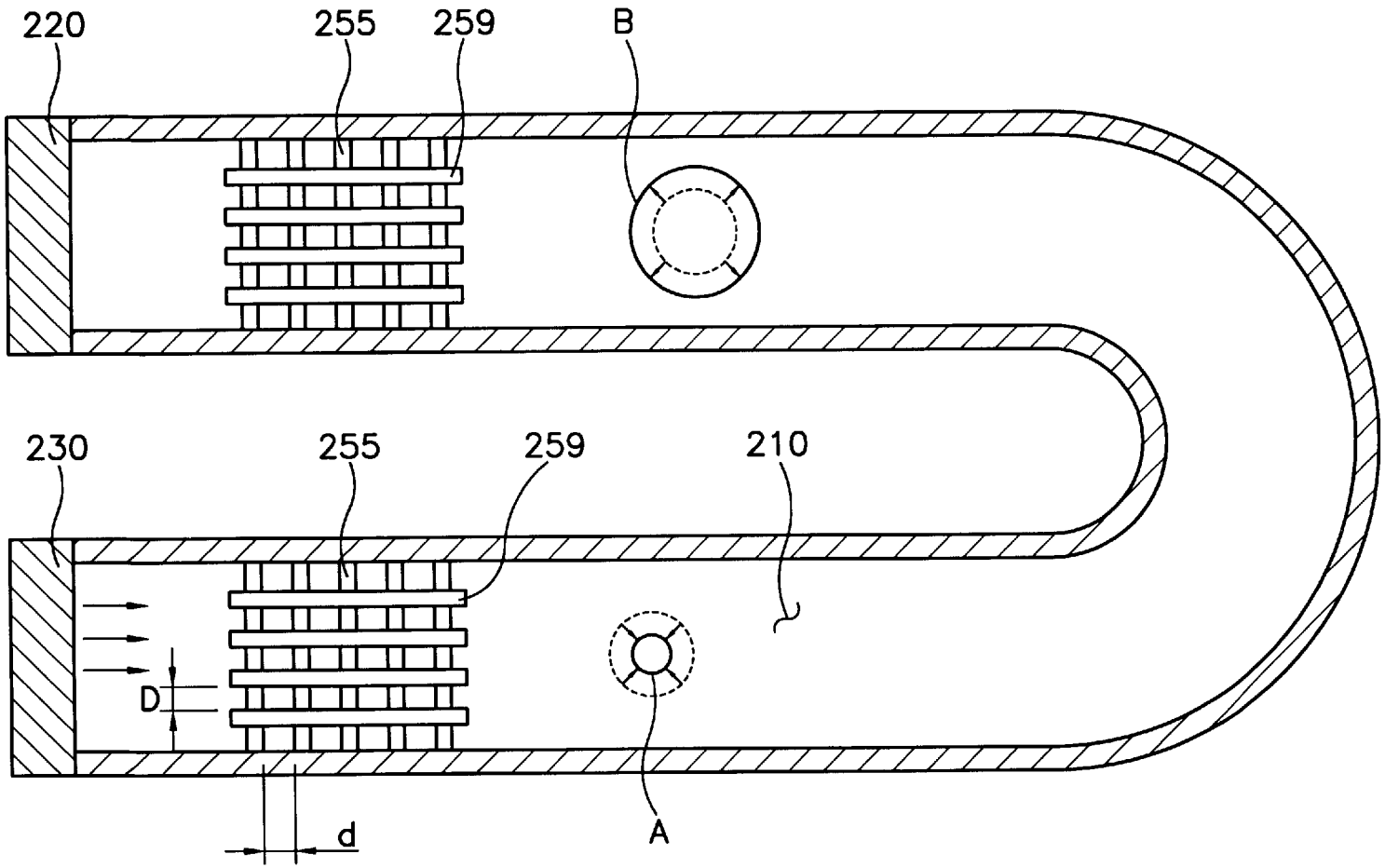
FIG. 6 is a sectional view showing parcels of a helium gas which are compressed or expanded in a resonator by an acoustic pressure applied thereto.

As shown in FIG. 6, a distance d between vertical plates 255 is preferably 1 mm and a distance D between horizontal plates 259 is preferably 1 mm.

Refrigerator 100 having ice maker 200 according to the present invention operates as follows.

Firstly, the water is supplied from water supplying device 50 into first ice tray 240. However, it is also possible for an user to manually supply the water into first ice tray 240. When the water is supplied by water supplying device 50, a sensor (not shown) detects the amount of the water in first ice tray 240 and sends a signal to electric control unit 300 when first ice tray 240 is fully filled up with the water.

Then, electric control unit 300 operates second speaker 230 attached to the front portion of the second end of U-shaped resonator 210.

Accordingly, second speaker 230 applies the acoustic pressure into U-shaped resonator 210 thereby compressing and expanding the parcels of the helium gas filled in U-shaped resonator 210.

That is, as detailedly shown in FIG. 6, the temperature of a parcel A of the helium gas adjacent to second speaker 230 is raised by adiabatic compression caused by a standing wave radiated from second speaker 230, and the temperature of a parcel B of the helium gas remoted from second speaker 230 is lowered by adiabatic expansion. Accordingly, the second end of U-shaped resonator 210 is heated and the first end of U-shaped resonator 210 is chilled.

First heat exchanger 260 disposed in the first end of U-shaped resonator 210 transfers the lowered temperature to first ice tray 240 thereby freezing the water filled in first ice tray 240.

The temperature of the helium gas is lowered at −290° C. when it is subjected to adiabatic expansion so the water filled in first ice tray 240 is rapidly frozen in a predetermined time. The predetermined time is obtained through a plurality of tests and is pre-set in electric control unit 300.

When the predetermined time lapses, electric control unit 300 operates reversible motor 280 so that U-shaped resonator 210 is rotated at the angle of 180 degrees by reversible motor 280.

When U-shaped resonator 210 rotates at the angle of 180 degrees, first ice tray 240 is replaced with second ice tray 250. That is, second ice tray 250 moves to a position where it can receive the water from water supplying device 50.

Then, the water is supplied into second ice tray 250 through water supplying device 50 and electric control unit 300 operates first speaker 220 attached to the front portion of the first end of U-shaped resonator 210.

Accordingly, the temperature of the parcels of the helium gas adjacent to first speaker 220 is raised by adiabatic compression caused by a standing wave radiated from first speaker 220, and the temperature of the parcels of the helium gas remote from first speaker 220 is lowered by adiabatic expansion. Therefore, the first end of U-shaped resonator 210 is heated and the second end of U-shaped resonator 210 is chilled.

At this time, first heat exchanger 260 disposed in the first end of U-shaped resonator 210 transfers the raised temperature to first ice tray 240 having ice cubes therein so that the ice cubes are separated from first ice tray 240. The ice cubes are collected in ice reservoir 60 disposed in a bottom wall of freezing chamber 1. In addition, second heat exchanger 270 transfers the lowered temperature to second ice tray 250 so the water filled in second ice tray 250 is frozen.

This process is continuously carried out by sequentially and repeatedly applying the electric signal to second speaker 230, reversible motor 280 and first speaker 220.

As described above, the ice maker according to the present invention makes the ice by using the thermoacoustic refrigeration so that the ice making time can be saved.

In addition, the ice maker can rapidly makes the ice without controlling the temperature of the evaporator, so the temperature distribution in the freezing chamber can be uniformly maintained.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a housing having a refrigerating chamber, a freezing chamber, and an evaporator chamber which is disposed at a rear portion of the freezing chamber;

an evaporator for generating a chilled air, the evaporator being disposed in the evaporator chamber;

a fan assembly for blowing the chilled air generated by the evaporator into the refrigerating and freezing chambers;

a first means installed in the freezing chamber and filled up with an inertia gas;

at least one ice tray attached to the first means;

a water supplying device for supplying a water into the ice tray;

a second means for compressing and expanding parcels of the inertia gas by applying an acoustic pressure to the first means;

a third means for transferring an inner temperature of the first means to the ice tray;

a fourth means for driving the first means in a forward or a reverse direction; and an electric control unit for sequentially operating the first and fourth means.

2. The refrigerator as claimed in claim 1, wherein the water supplying device includes a water tank provided on an upper surface of the housing and a water supplying pipe which is disposed at a lower portion of the water tank and extends into the freezing chamber by passing through an upper wall of the housing, the water supplying pipe being provided at a circumference thereof with a heating coil for preventing the water supplying pipe from freezing.

3. The refrigerator as claimed in clam 1, wherein the first means includes a U-shaped resonator filled up with a helium gas, parcels of the helium gas being compressed and expanded by the second means thereby varying a temperature distribution in the U-shaped resonator.

4. The refrigerator as claimed in claim 3, wherein the second means includes a first speaker attached to a front portion of a first end of the U-shaped resonator and a second speaker attached to a front portion of a second end of the U-shaped resonator, the electric control unit sequentially applying an electric signal to the first and second speakers at a predetermined time interval so that the first and second speakers are sequentially operated while maintaining the predetermined time interval.

5. The refrigerator as claimed in claim 3, wherein the ice tray includes a first ice tray and a second ice tray which are disposed in a reverse direction to each other, the first ice tray being positioned on an upper surface of the first end of the U-shaped resonator, the second ice tray being positioned on an lower surface of the second end of the U-shaped resonator.

6. The refrigerator as claimed in claim 5, wherein the third means includes first and second heat exchangers provided in the U-shaped resonator, the first heat exchanger is adjacent to the first end of the U-shaped resonator and the second heat exchanger is adjacent to the second end of the U-shaped resonator.

7. The refrigerator as claimed in claim 6, wherein the first and second heat exchangers are positioned corresponding to the first and second ice trays, respectively.

8. The refrigerator as claimed in claim 6, wherein each heat exchanger has a lattice shape and includes a plurality of vertical plates which are positioned in a row and formed with a plurality of longitudinal slots and a plurality of horizontal plates which are inserted into the longitudinal slots so that the vertical plates are connected to one another.

9. The refrigerator as claimed in claim 6, wherein the fourth means includes a reversible motor installed in the evaporator chamber, a rotating shaft of the reversible motor extending into the freezing chamber and connecting to the U-shaped resonator, the electric control unit rotating the U-shaped resonator at an angle of 180 degrees when an ice making process is completed.

10. An automatic ice maker comprising:

a resonator filled up with an inertia gas;

at least one ice tray attached to the resonator;

a first means for compressing and expanding parcels of the inertia gas by applying an acoustic pressure to the resonator thereby varying a temperature distribution in the resonator;

a second means for transferring an inner temperature of the resonator to the ice tray;

a reversible motor for driving the resonator in a forward or a reverse direction at an angle of 180 degrees; and an electric control unit for sequentially operating the first means and the reversible motor.

11. The automatic ice maker as claimed in claim 10, wherein the resonator has a U-shape and is filled up with a helium gas.

12. The automatic ice maker as claimed in claim 10, wherein the first means includes a first speaker attached to a front portion of a first end of the U-shaped resonator and a second speaker attached to a front portion of a second end of the U-shaped resonator, the electric control unit sequentially applying an electric signal to the first and second speakers at a predetermined time interval so that the first and second speakers are sequentially operated while maintaining the predetermined time interval.

13. The automatic ice maker as claimed in claim 10, wherein the ice tray includes a first ice tray and a second ice tray which are disposed in a reverse direction to each other, the first ice tray being positioned on an upper surface of the first end of the U-shaped resonator, the second ice tray being positioned on an lower surface of the second end of the U-shaped resonator.

14. The automatic ice maker as claimed in claim 13, Wherein the second means includes first and second heat exchangers provided in the U-shaped resonator, and the first and second heat exchangers are positioned corresponding to the first and second ice trays, respectively.

15. The automatic ice maker as claimed in claim 14, wherein each heat exchanger has a lattice shape and includes a plurality of vertical plates which are positioned in a row and formed with a plurality of longitudinal slots and a plurality of horizontal plates which are inserted into the longitudinal slots so that the vertical plates are connected to one another.

* * * * *